US012768607B2

(12) United States Patent
May

(10) Patent No.: US 12,768,607 B2
(45) Date of Patent: Oct. 20, 2026

(54) BALLISTIC MULTI-PART CHAMBER LOCKING ASSEMBLY

(71) Applicant: Joshua May, Portland, OR (US)

(72) Inventor: Joshua May, Portland, OR (US)

( * ) Notice: Subject to any disclaimer, the term of this patent is extended or adjusted under 35 U.S.C. 154(b) by 17 days.

(21) Appl. No.: 19/034,541

(22) Filed: Jan. 22, 2025

(65) Prior Publication Data

US 2026/0185789 A1 Jul. 2, 2026

Related U.S. Application Data

(62) Division of application No. 18/396,293, filed on Dec. 26, 2023, now Pat. No. 12,235,063.

(60) Provisional application No. 63/523,563, filed on Jun. 27, 2023, provisional application No. 63/437,956, filed on Jan. 9, 2023.

(51) Int. Cl.

| | |
|---|---|
| ***F41A 3/02*** | (2006.01) |
| ***F41A 3/00*** | (2006.01) |
| ***F41A 3/54*** | (2006.01) |
| ***F41A 3/66*** | (2006.01) |
| ***F41A 5/24*** | (2006.01) |

(52) U.S. Cl.
CPC ..... *F41A 3/54* (2013.01); *F41A 3/00* (2013.01); *F41A 3/66* (2013.01); *F41A 5/24* (2013.01)

(58) Field of Classification Search
CPC ..... F41A 3/02; F41A 3/10
See application file for complete search history.

(56) References Cited

U.S. PATENT DOCUMENTS

| | | | | |
|---|---|---|---|---|
| 2,453,830 | A * | 11/1948 | Chadwick | F41A 25/18 89/44.01 |
| 2,865,126 | A | 12/1958 | Dardick | |
| 3,104,588 | A * | 9/1963 | Glorvig | F41A 9/06 89/33.03 |
| 3,501,998 | A | 3/1970 | Dardick | |
| 3,540,345 | A | 11/1970 | Wolfe | |
| 3,760,683 | A | 9/1973 | Seemann | |
| 4,604,942 | A | 8/1986 | Benelli | |
| 5,392,685 | A | 2/1995 | Stoner | |
| 9,995,542 | B1 | 6/2018 | Sahin et al. | |
| 10,203,172 | B2 | 2/2019 | Dechant | |

(Continued)

FOREIGN PATENT DOCUMENTS

EP 36179193 6/2018

*Primary Examiner* — J. Woodrow Eldred
(74) *Attorney, Agent, or Firm* — Kirk A. Buhler; Buhler & Associates Patenting

(57) ABSTRACT

Improvements in a ballistic with a multi-part chamber locking assembly is disclosed to allow the casing ejection and reloading sequence to be temporarily slowed down to capture the optimum amount of ignited gun powders expanding gas, prior to the round exiting the barrel. Large slide component(s) of a firearm are replaced with a multi-part chamber locking assembly. This negates the requirement for a round to move laterally after moving vertically. The round only moves vertically thus mitigating the requirement for any forward motion. The multi-part chamber reduces the weight and materials needed to actuate all components of the ejecting and reloading process, so more energy is available to transfer movement of casing ejecting. The round is fired with a hammer or striker through impingement or a firing pin actuated action on a primer to ignite the propellant.

16 Claims, 11 Drawing Sheets

(56) References Cited

U.S. PATENT DOCUMENTS

| | | | |
|---|---|---|---|
| 2011/0220088 | A1 | 9/2011 | Maggiore |
| 2011/0281242 | A1 | 11/2011 | Charles et al. |
| 2014/0102287 | A1 | 4/2014 | Jebsen et al. |
| 2014/0251118 | A1 | 9/2014 | Moretti |
| 2017/0074607 | A1 | 3/2017 | Lewis |
| 2017/0198993 | A1 | 7/2017 | Dechant |
| 2018/0172375 | A1 | 6/2018 | Stangl et al. |
| 2019/0195581 | A1 | 6/2019 | Cassels |
| 2020/0292261 | A1 | 9/2020 | Wood et al. |

* cited by examiner

BALLISTIC MULTI-PART CHAMBER LOCKING ASSEMBLY

CROSS-REFERENCE TO RELATED APPLICATIONS

This application is a divisional application of co-pending application Ser. No. 18/396,293 that was filed on Dec. 26, 2023 that claims the benefit of Provisional Application Ser. No. 63/437,956 filed Jan. 9, 2023, and Provisional Application Ser. No. 63/523,563 filed Jul. 7, 2023, and claims priority to International PCT application PCT/US24/010740 that was filed on Mar. 29, 2024, the entire contents of which is hereby expressly incorporated by reference herein.

PRIOR ART

U.S. Pat. No. 4,604,942 issued on Aug. 12, 1986, to Paolo Benelli and is titled Bolt Assembly with a Rotating Locking Bolt Head and a Floating Bolt Element for Automatic Firearms. This patent discloses a bolt assembly for an automatic firearm which operates using kinetic recoil energy that includes a floating bolt element, a rotatable locking bolt head and a return spring interposed between them, all in communication with the barrel. The bolt head is formed with a cylindrical portion having two crescent shaped projections located at diametrically opposite points along the circumference of the cylindrical portion. The barrel is also formed with a pair of grooves, each groove associated with a recess such that the projections may enter and exit the grooves through the recesses. Upon firing, the return spring is compressed which momentarily keeps the bolt head in a locked position which causes a delay to allow for the dissipation of pressures in the barrel. While this patent is for a rotating bolt head the reloading is from inertia as opposed to utilizing the expanding gunpowder gas.

U.S. Patent Publication Number 20180172375 was published on Jun. 21, 2018, to Herbert Stangle et al., and is titled Firearm of the Rotating Bolt Type. This publication discloses a firearm of the rotating bolt type includes a housing part made of plastic or metal, a metal bolt carrier guide, a bolt carrier that is guided by the bolt carrier guide and that has a bolt head rotatably mounted that is held by the housing part, a metal barrel nut in which a barrel can be fixed and in which the bolt head can be locked. The bolt carrier guide is directly connected with the barrel nut so that it is rigid with respect to movement, at least in the longitudinal direction of the firearm. While this publication is for a rotating bolt, the bolt must travel rearward in the firearm for ejecting the shell.

European Number EP3179193 was granted on Jun. 27, 2018, to Friedrich Dechant and is titled Pistol with rotating barrel. This patent discloses a pistol with a frame, a closure movable thereon and a rotary run located in the closure. The rotation is rotated by cams and grooves with respect to the closure between a locked position and an open position and moved axially. To avoid the usual wear in such weapons wear is provided that the closure has an obliquely to the axis of the soul extending abutment surface, and the barrel a corresponding contact surface. Thus, when locking by the surface contact between these surfaces, the beginning of the relative rotational movement is initiated. Thus, it is possible to reduce the wear by order of magnitude by precisely guided and directed interaction. While this patent is for a rotating barrel, the closure uses an oblique closure as opposed to using a round closure with a rotational spring.

What is needed is a ballistic with a rotating, or otherwise laterally/vertically separating chamber where components can move in any direction to separate, and thus create a chamber around newly loaded firearm casing/round that has a reduced weight and materials needed to actuate all of the components, so more energy is available to transfer rotating energy, instead of the typical lateral slide movement. It should also remove the large slide component and replace it with a two-part chamber locking assembly to negate the requirement for a round to move laterally after moving vertically. The proposed ballistic with a two-part chamber locking assembly disclosed in this document provides the solution.

BACKGROUND OF THE INVENTION

This invention relates to improvements in ballistic/firearms. More particularly, the present firearm with a multi-part chamber locking assembly where the breach rotates or otherwise separates into multiple parts to eject and reload a new cartridge. The firearm can be a handgun, rifle or general artillery system.

Most ballistics use the recoil of the expanding gunpowder in a cartridge to propel a projectile, eject the casing and rechamber a new round. This is most commonly performed by the bolt moving backwards to then strip a round. Some firearms use a rotating bolt that allows for the bolt to rotate for discharging the spent casing and reloading a new cartridge. A number of patents and or publications have been made to address these issues. Exemplary examples of patents and or publication that try to address this/these problem(s) are identified and discussed herein.

SUMMARY OF THE INVENTION

It is an object of the ballistic with multi-part chamber locking assembly to allow the casing ejecting and the reloading sequence to be temporarily slowed down to capture the optimum amount of expanding gun powder prior to the round exiting the barrel, this is typically done through a lug or pivoting hinge point, which pivots off of the lower frame.

It is an object of the ballistic with multi-part chamber locking assembly to remove the large slide component(s) and replace it with a two-part cylindrical locking assembly. This negates the requirement for a round to move laterally after moving vertically. The round only moves vertically thus mitigating the requirement for any forward motion.

It is another object of the ballistic with multi-part chamber locking assembly to reduce the weight and materials needed to actuate all components of the ejecting and reloading so more energy is available to transfer rotating or multi-directional ejecting energy, instead of the common rearward/forward loading movement of the casing ejecting process.

It is another object of the ballistic with multi-part chamber locking assembly in the hammer or striker to have a direct impingement or a firing pin actuated action on a primer to ignite the propellant. This striking action can actuate mechanically off the rotating cylinder, electrically, magnetically, hydraulically, though ferro fluid or chemically.

It is still another object of the ballistic with multi-part chamber locking assembly for the primary actuating to occur through either direct impingement and piston gas that assist to first push the cylindrical cap, rotary cylinder, striker/hammer—lock/back and other machine required actuations.

Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION

Figure 1:
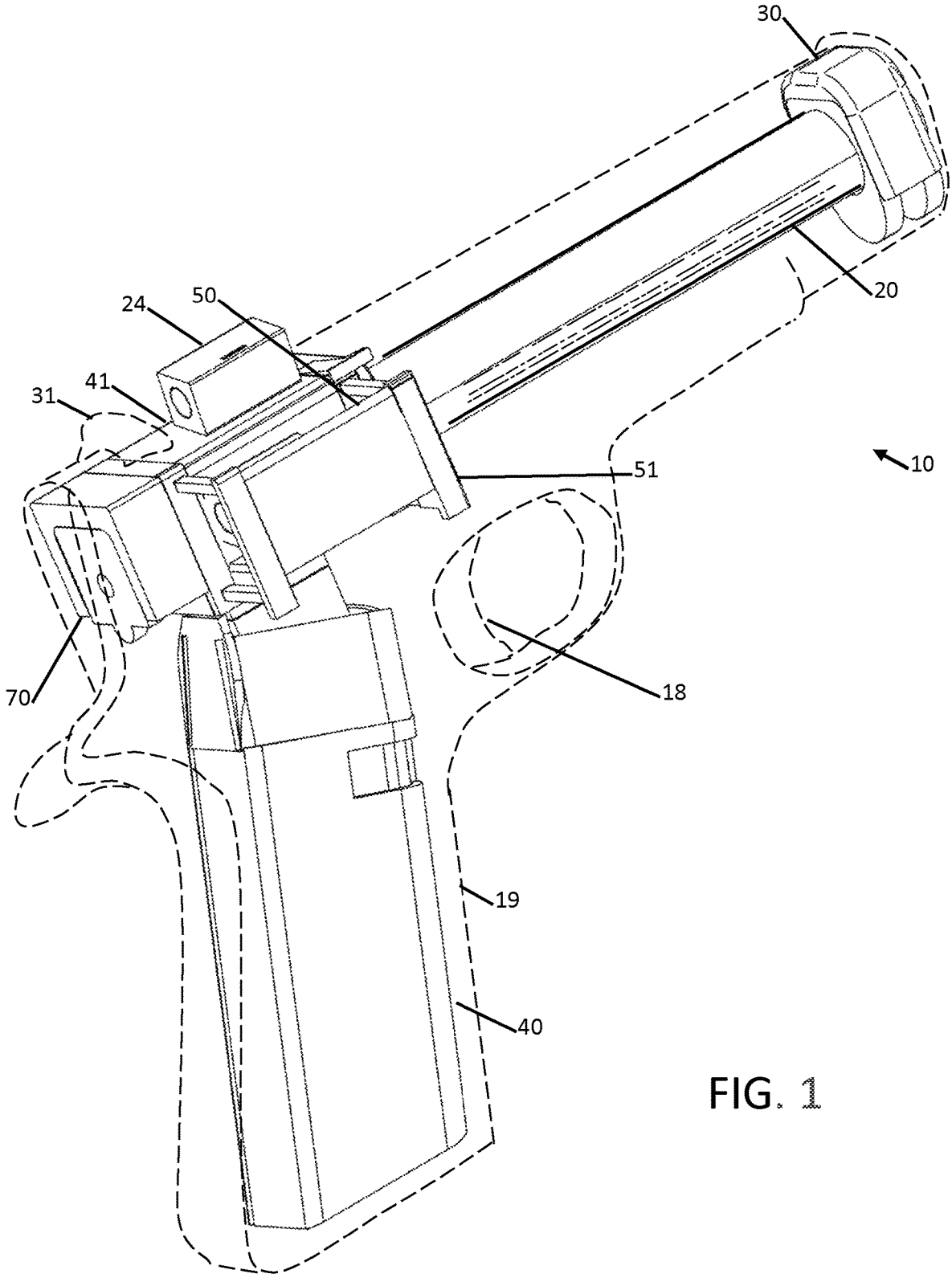
FIG. 1 shows a ballistic with a two-part chamber locking assembly.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention but is merely representative of various embodiments of the invention. The illustrated embodiments of the invention will be best understood by reference to the drawings, wherein like parts are designated by like numerals throughout.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated. The terminology used herein is for the purpose of describing particular embodiments only and is not intended to be limiting of the technology. As used herein, the singular forms "a," "an," and "the" are intended to include the plural forms as well, unless the context clearly indicates otherwise.

It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof. It will be understood that like or analogous elements and/or components, referred to herein, may be identified throughout the drawings with like reference characters.

---

10 firearm
17 barrel housing
18 trigger
19 hand grip
20 barrel
21 chamber
22 opening
23 bore
24 spent casing
25 shell in chamber
26 shell in que
27 shell guide
28 notch
29 pivot axle
30 front site block
31 rear site block
32 rotary chamber assembly
33 ejector port
34 front frame
35 rear frame
36 rear rotation frame
37 front rotation frame
38 circular breach frame
39 front spring
40 lower frame
41 upper frame
42 barrel opening
43 recess
47 pivot axle
48 shell recess
49 shell tab
50 translating chamber
51 ejector door
52 bottom of breach
53 linear slide
54 slide door lock
55 casing ejector
56 breach shell retainer
57 shell ejector pocket
58 ejection door
59 linear slide passage
60 tip
61 rear spring
70 hammer mechanism
71 hammer pivot
72 firing pin
73 firing pin hole
80 side gas tube
81 front tube in the barrel
82 manifold tube
83 port
84 upper port
85 side port
86 rear port
87 side port
88 front gas tube
90 rotate -continued

| | |
|---|---|
| 91 | out |
| 92 | pull |
| 93 | rotate/flip |
| 94 | index |
| 95 | up |
| 96 | close |

FIG. 1 shows a ballistic 10 with a two-part locking assembly. This figure gives a general understanding of the components of the two-part chamber locking assembly within ballistic 10. The two-part locking assembly is shown in a 1911 frame handgun configuration. ballistic 10 is shown with housing, a handgrip 19 and a trigger 18. The two-part locking assembly is integrated in the ballistic 10 and extends with an internal barrel 20 having a front site block 30 at one end of the barrel 20 and a rear site block 31 at the opposing end. The two-part cylindrical locking assembly is shown within a translating barrel assembly 50 having a side ejector door 51 port. The internal features and function of the loading, firing of the hammer mechanism 70 and a spent casing 24 ejection is shown. The two-part locking assembly has an upper frame 41 and lower frame 40 element integrated into the 1911 frame with the hand grip 19.

Figure 2:
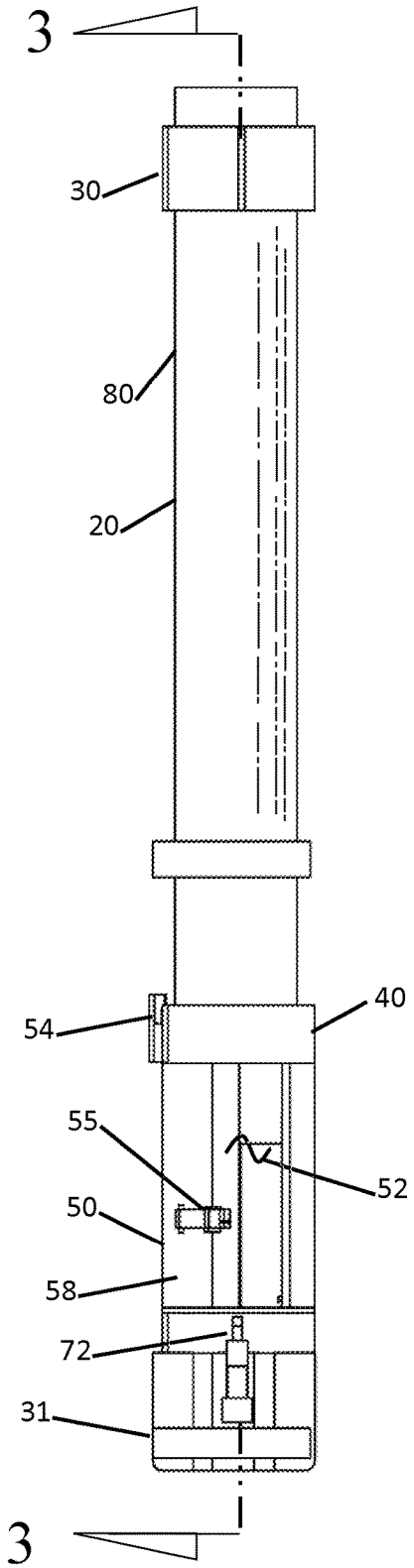
FIG. 2 shows a bottom view of the two-part chamber locking assembly with the exterior housings removed.
Figure 3:
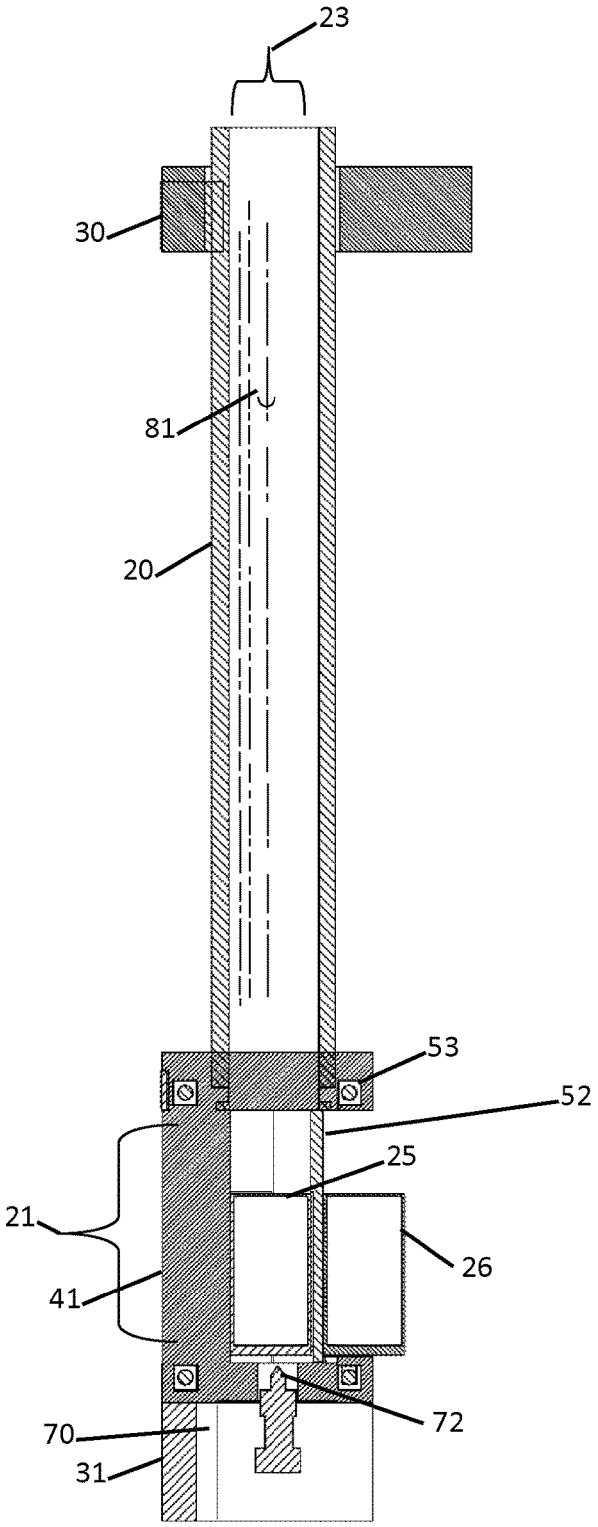
FIG. 3 is a side cross-sectional view taken through section line 3-3 from FIG. 2.

FIG. 2 shows a bottom view of the two-part locking assembly with the exterior housings removed, and looking at the bottom of the breach 52, and FIG. 3 is a side cross-sectional view taken through section line 3-3 from FIG. 2. The barrel 20 is shown extending vertically in these figures and terminating through the front site block 30. At the other end of barrel 20, barrel 20 terminates in the fixed portion of the translating barrel assembly 50. View 2 shows a slide door lock 54 that is configured to hold the breach shut while firing and casing ejector 55 in the translating barrel assembly 50 of the ejector door 58. The The translating barrel assembly 50 chambers a cartridge with a projectile (not shown) in chamber 21 of a breach 52. One side of chamber 21 translates by moving one side of the breach on linear slide(s) 53. Translating barrel assembly 50 is biased by a spring or springs that hold the door in a closed configuration. A trigger mechanism 70 is retained in the rear site block 31. The trigger mechanism is shown in FIG. 3 with a hammer pivot 71 where the hammer mechanism 70 rotates so the hammer pushes a firing pin 72 into the primer (not shown) of the cartridge (not shown) to ignite gunpowder within the cartridge to propel a projectile (not shown) down the barrel 20. While these figures show a cartridge with gunpowder, it is contemplated that the firearm can include an option to store gun powder or propellent separate from the round loaded into the chamber.

The hammer mechanism 70 or striker is shown in this embodiment with a direct impingement or piston actuated action on the primer of a cartridge, however it's anticipated that the mechanism can actuate mechanically off of the rotating chamber, electrically, hydraulically, though ferro fluid or chemically. The actuation can utilize aspects from a common revolver, which includes single and double actions that move the hammer/strike, primary cylinder, cylinder cap, and ejector system.

FIG. 3 also shows the upper frame 41 that retained in the grip of the firearm with a shell in chamber 25 and another shell in queue 26. When the cartridge is fired the expanding gunpowder propels the projectile out of the barrel 20 and the expanding gunpowder extends the translating barrel assembly 50 to overcome the spring(s) where the spent casing is ejected out of the side of the rotary barrel assembly 50 out of an ejector port 51. For better clarity of the translating chamber assembly 50 the site blocks 30 and 31 are removed in some or all of the next few figures.

Figure 4:
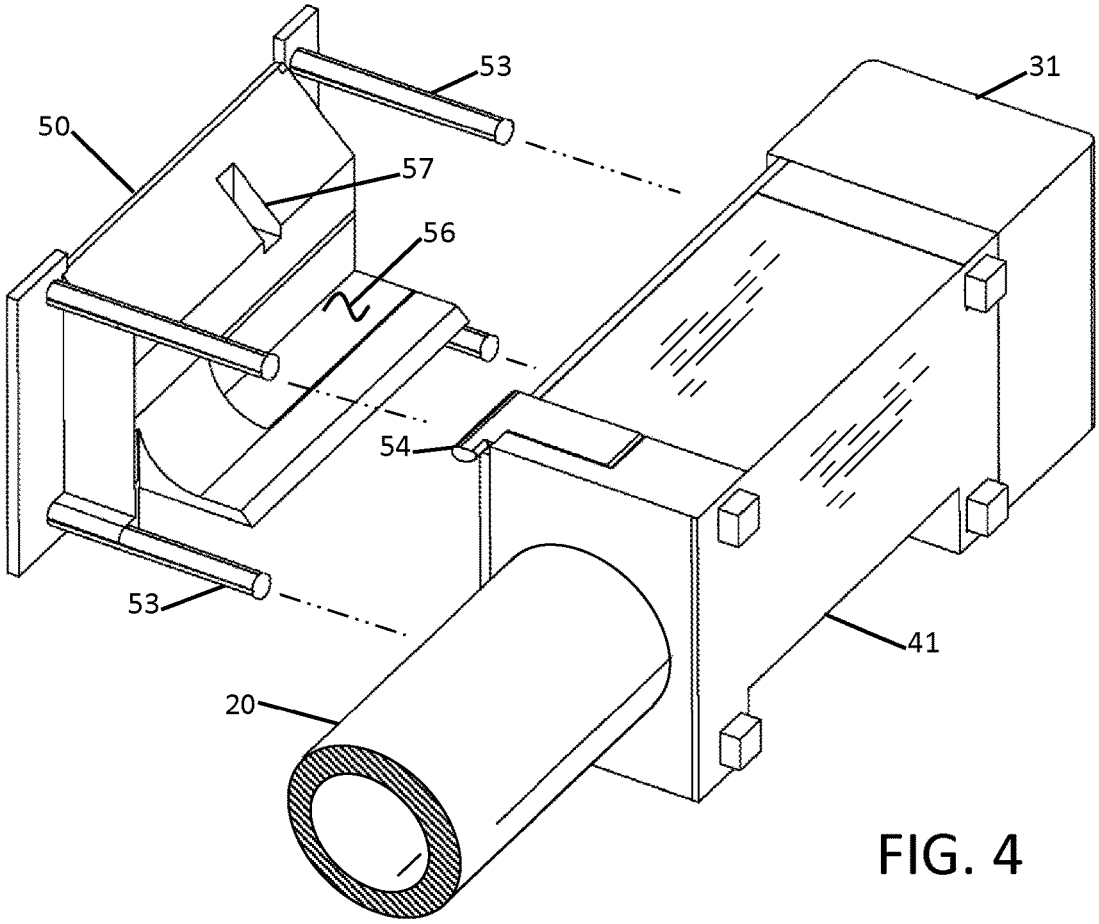
FIG. 4 shows a front perspective view of the upper frame with the translating chamber assembly opened.
Figure 5:
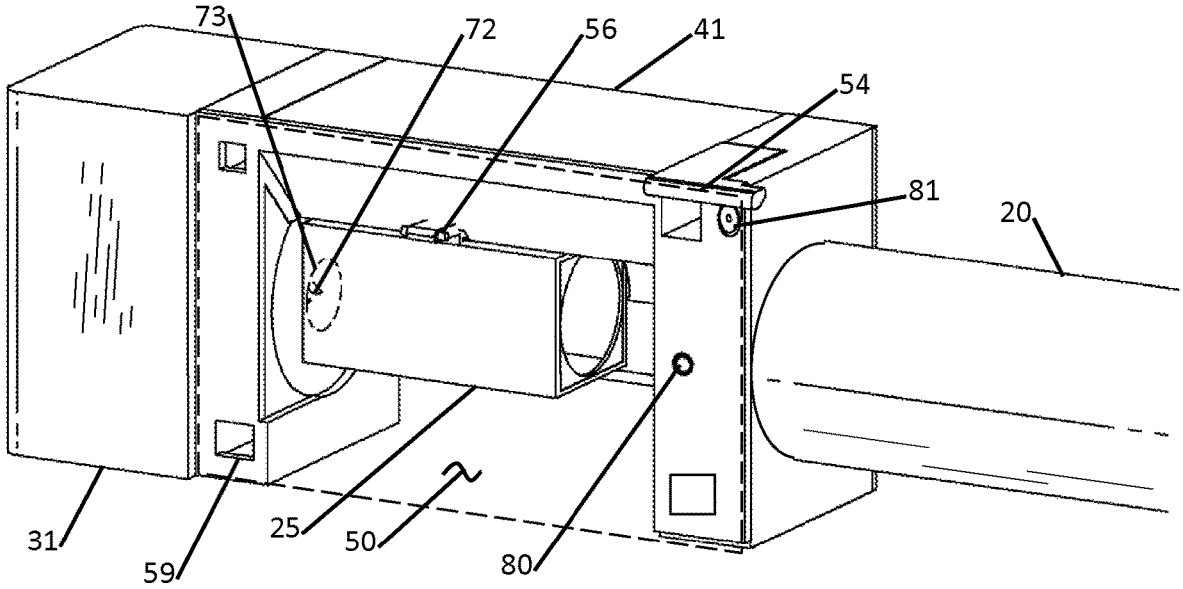
FIG. 5 shows another perspective view of the firing chamber with a transparent translating chamber assembly.

FIG. 4 shows a front perspective view of the upper frame with the translating barrel assembly opened and FIG. 5 shows another perspective view of the firing chamber with a transparent translating barrel assembly. In FIG. 4 the translating barrel assembly 50 is shown displaced from the upper frame 41 and the rear site block 31 and the chamber 20 to show more of the detail in the translating barrel assembly 50. The linear slide(s) 53 pass and are guided into the upper frame 41 in linear slide passage(s) 59. When the translating barrel assembly 50 is completely installed into the upper frame 41 the translating barrel assembly 50 is locked onto the upper frame 41 with a slide door lock 54 that retains the position of the translating chamber assembly 50 until the projectile is launched.

The translating barrel assembly 50 has a breach casing retainer 56 with a complementary recess in the upper frame 41 for the other (far) corner of a casing. In this embodiment the shell in chamber 25 would be rectangular or square. The translating barrel assembly 50 has a casing ejector pocket 57 where a breach casing retainer 56 operates. The breach casing retainer 56 is shown and described in more detail in other figures herein. The shell is fired when the firing pin 72 extends through the firing pin hole 73 and into the shell or a primer in the shell. Expanding gunpowder passes through the front tube in barrel 81 to unlock the slide door lock 54. A second side gas tube 80 pushes open the translating barrel assembly 50.

Figure 6:
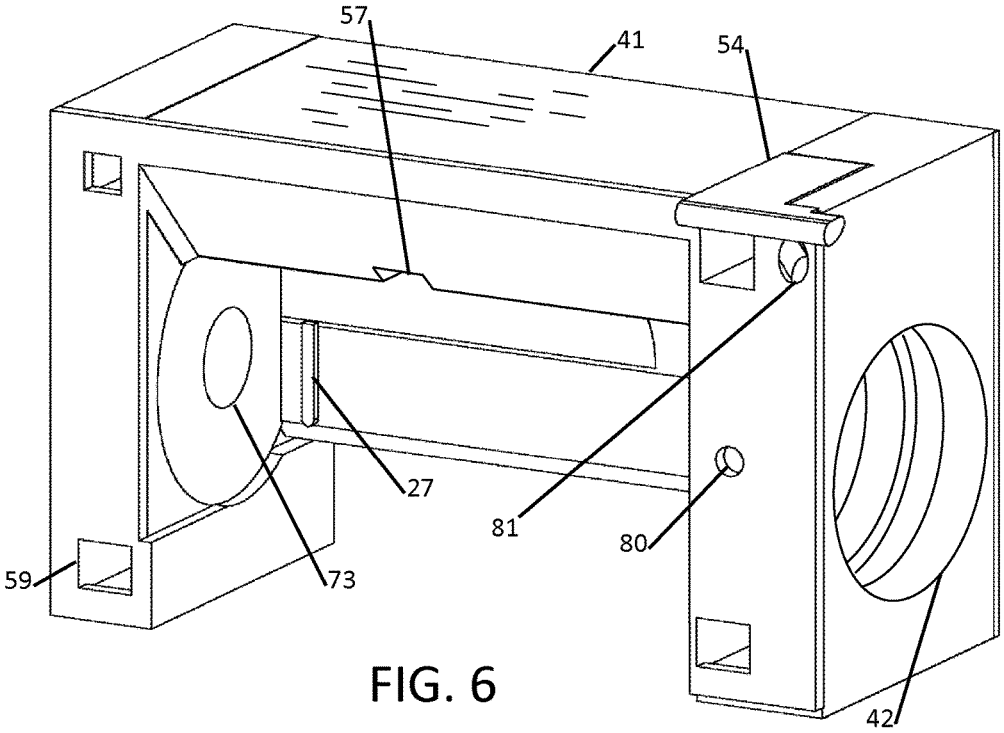
FIG. 6 shows a perspective view of the upper frame.
Figure 7:
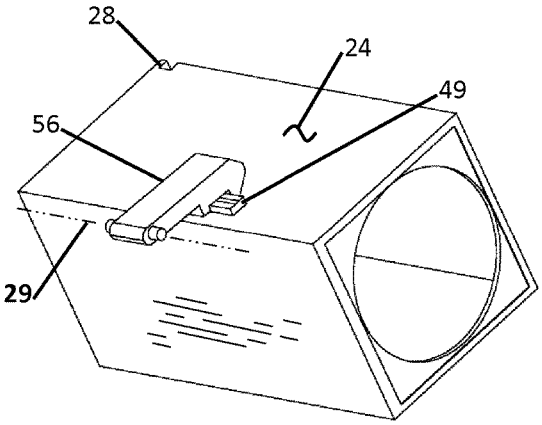
FIG. 7 shows a casing on the casing ejector.
Figure 8:
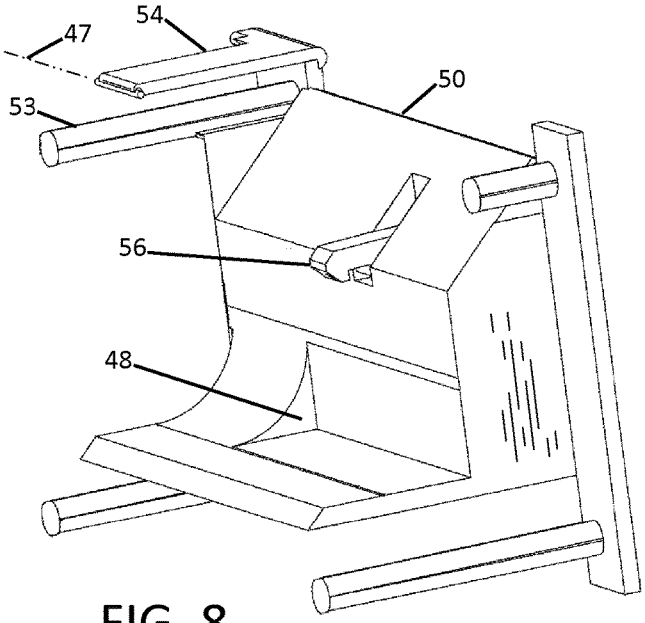
FIG. 8 shows the translating chamber assembly.

FIG. 6 shows a perspective view of the upper frame FIG. 7 shows a casing on the casing ejector and FIG. 8 shows the translating barrel assembly. Starting with FIG. 7 the spent casing 24 is shown on the breach casing retainer 56. The breach casing retainer 56 locks onto the casing tab 49 within the casing ejector pocket 57. The breach casing retainer 56 holds the casing tab 49 on the casing. The casing tab 49 can extend out a side of the casing or could be a recess in the side of the casing.

The breach casing retainer 56 rotates on a pivot axle 29 on the translating chamber assembly 50 as the translating barrel assembly 50 translates out of the upper frame 41 as the linear slide(s) 53 pass in the linear slide passage(s) 59. In the closed position the slide door lock 54 holds the translating barrel assembly 50 closed. When the shell is fired, the expanding gunpowder passes through the front tube in barrel 81 to unlock the slide door lock 54. The slide door lock 54 pivots on pivot axle 47. A second side gas tube 80 pushes open the translating barrel assembly 50.

On one side of the shell is a notch 28 that runs down the entire side. This notch 28 guides the casing on a casing guide 27 in the back of the upper frame 41. The casing recess 48 in the translating barrel assembly 50 pushes the casing into the casing guide 27. Notch 28 and casing guide 27 hold the casing is position on the firing pin hole 73. The far end of the upper frame 41 is the barrel opening 42.

Figure 9:
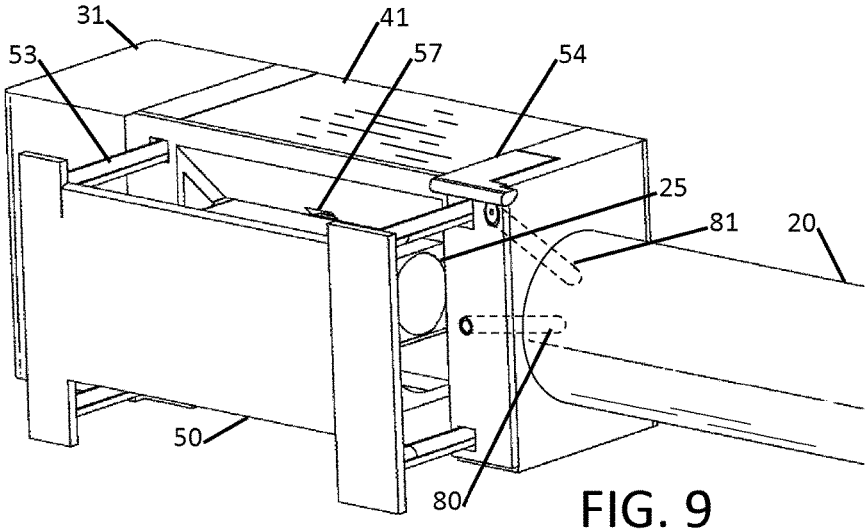
FIG. 9 shows a perspective view of the chamber assembly with the gas tubes passing from the barrel to the translating chamber assembly.

FIG. 9 shows a perspective view of the chamber assembly with the gas tubes passing from barrel 20 to the translating barrel assembly 50 on the upper frame 41 and the rear site block 31. This figure shows the firearm midway through the firing and ejection with the spent casing in chamber 25. The translating barrel assembly 50 is displaced and moves on linear slide(s) 53. The slide door lock 54 has released the translating barrel assembly 50 and the spent casing 25 is being pulled out of the upper frame 41 as the breach casing retainer clears the casing ejector pocket 57. The passages of the side gas port 80 and the front tube in the barrel 81 are shown as broken lines passing through the barrel 20 and the upper frame 41.

Figure 10A:
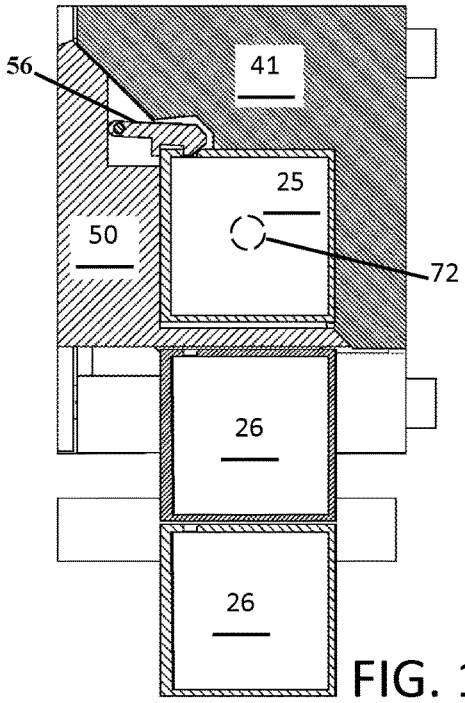
FIGS. 10A-10F show cross section of the stages of firing and reloading.

FIGS. 10A-10F show cross section of the stages of firing and reloading. In FIG. 10A the shell 25 is in the chamber until the firing pin 72 strikes shell 25. Multiple shells are in que 26 in the firearm. The shell 25 is retained is the two-part breach consisting or the upper frame 41 and the translating chamber assembly 50. The breach shell retainer 56 holds the tab or recess on the shell 25. When shell 25 is fired, expanding exhaust gases unlock the slide door lock and push open the translating barrel assembly 50.

Figure 10B:
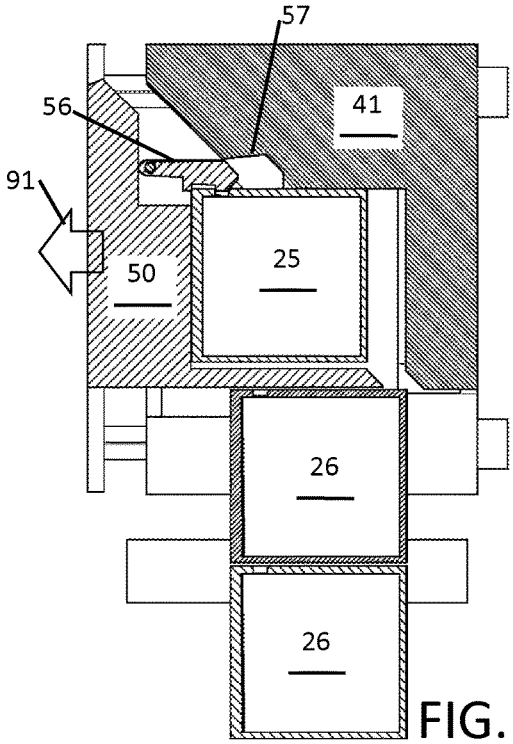

FIG. 10B shows the firearm just after shell 25 is fired. The translating chamber assembly 50 moves out 91 and the breach casing retainer 56 pulls the casing 25 as it moves out 91 on the linear slide(s) 53. The breach casing retainer 56 is beginning the clear the casing ejector pocket 57 and the movement continues in FIG. 10C.

Figure 10C:
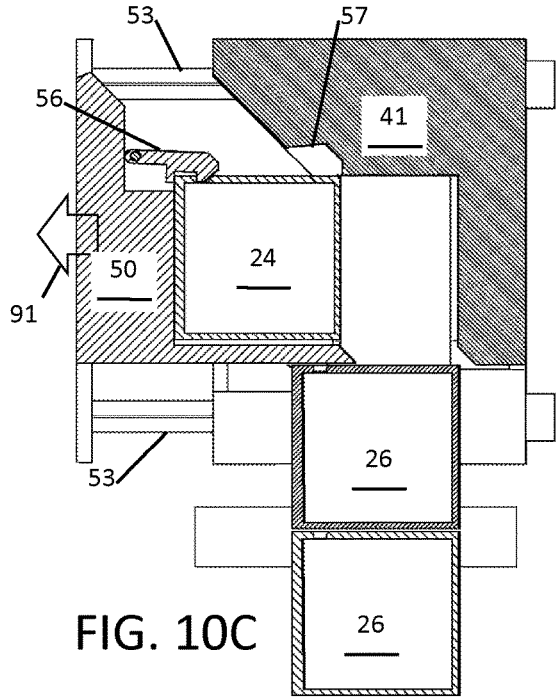
Figure 10D:
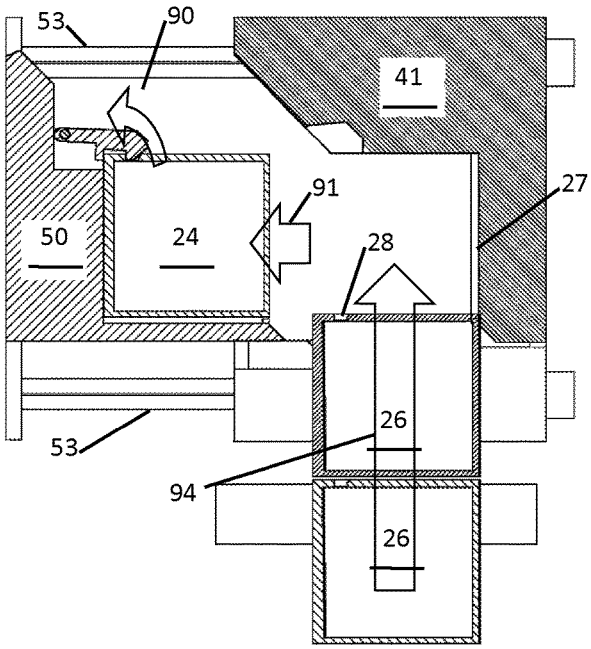

From FIG. 10C the free end of the spent casing 24 is clearing the casing ejector pocket 57 as the translating chamber assembly 50 continues to move out 91. In FIG. 10D the bottom of the translating barrel assembly 50 clears the top of the casing in queue 26 and the shell in queue 26 can begin to index 94 up into the breach. The breach casing retainer 56 can rotate 90 the lift and eject the spent casing 24 out of the breach as the shell in the que 26 moves into the breach. The shell in queue 26 is guided by the shell guide 27 with the notch 28 in the shell and into the upper frame 41.

Figure 10E:
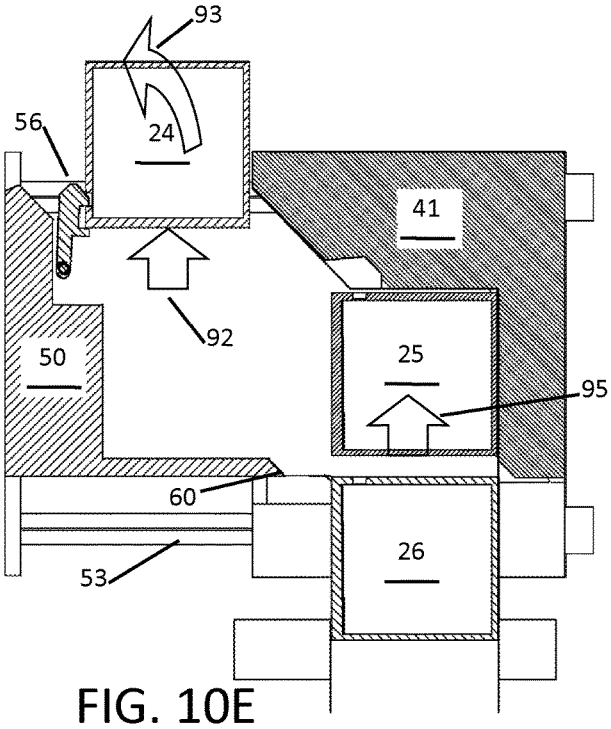
Figure 10F:
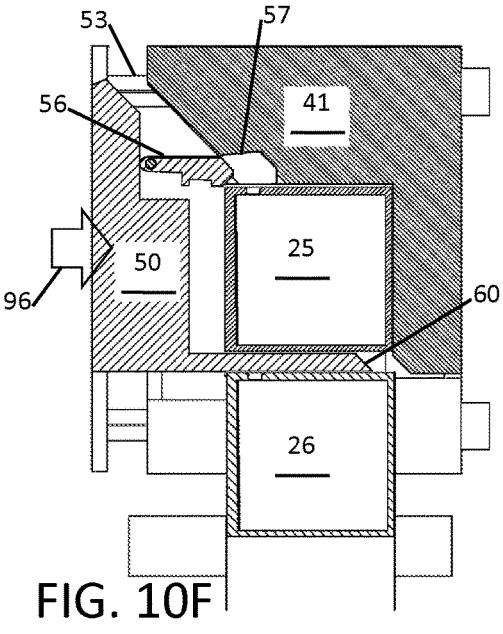

In FIG. 10E the spent casing 24 is pulled 92 up and rotated or flipped 93 out of the translating barrel assembly 50 as the new shell is seated up 95 in the breach. The tip 60 of the blade moves with the translating barrel assembly 50 to pass between the shell in the chamber 25 and the shell in the que 26 as the translating chamber assembly 50 closes 96 as the breach shell retainer 56 engages into the notch in the shell in the casing ejector pocket 57.

Figure 11:
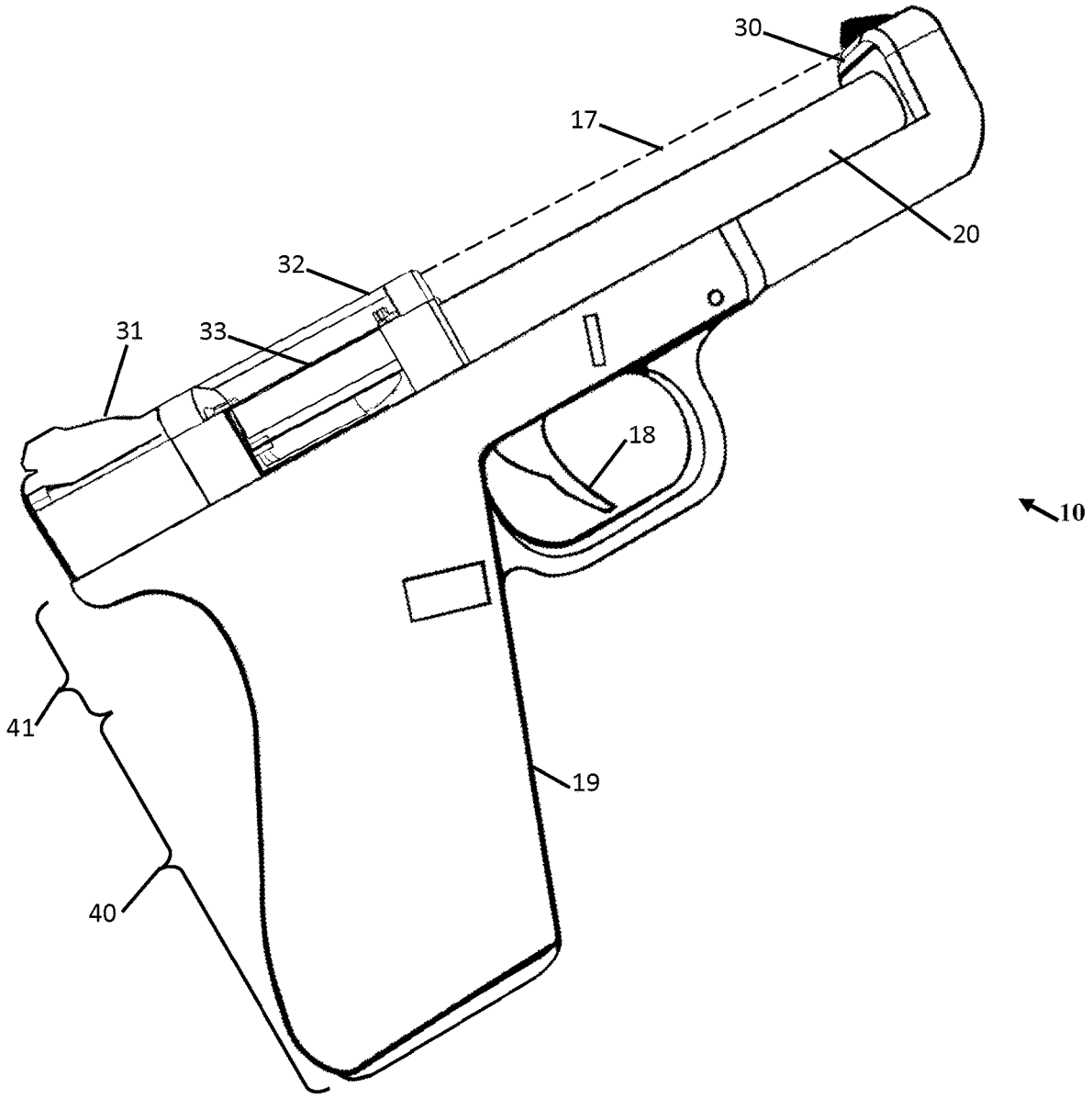
FIG. 11 shows a ballistic with a two-part chamber locking assembly.

FIG. 11 shows a ballistic 10 with a two-part chamber locking assembly. This figure gives a general understanding of the components of the two-part chamber locking assembly within ballistic 10. The two-part chamber locking assembly is shown in a striker pattern handgun configuration. Ballistic 10 is shown with housing, a handgrip 19 and a trigger 18. The two-part chamber locking assembly is integrated in the ballistic 10 and extends through a barrel housing 17 with an internal barrel 20 having a front site block 30 at one end of the barrel 20 and a rear site block 31 at the opposing end. The two-part cylindrical locking assembly is shown within rotary barrel assembly 32 having a side ejector port 33. The internal features and function of the loading, firing of the hammer and shell ejection will be shown and described in more detail with figures and description in this document. The two-part cylindrical locking assembly has an upper frame 41 and lower frame 40 elements in the hand grip 19.

Figure 12:
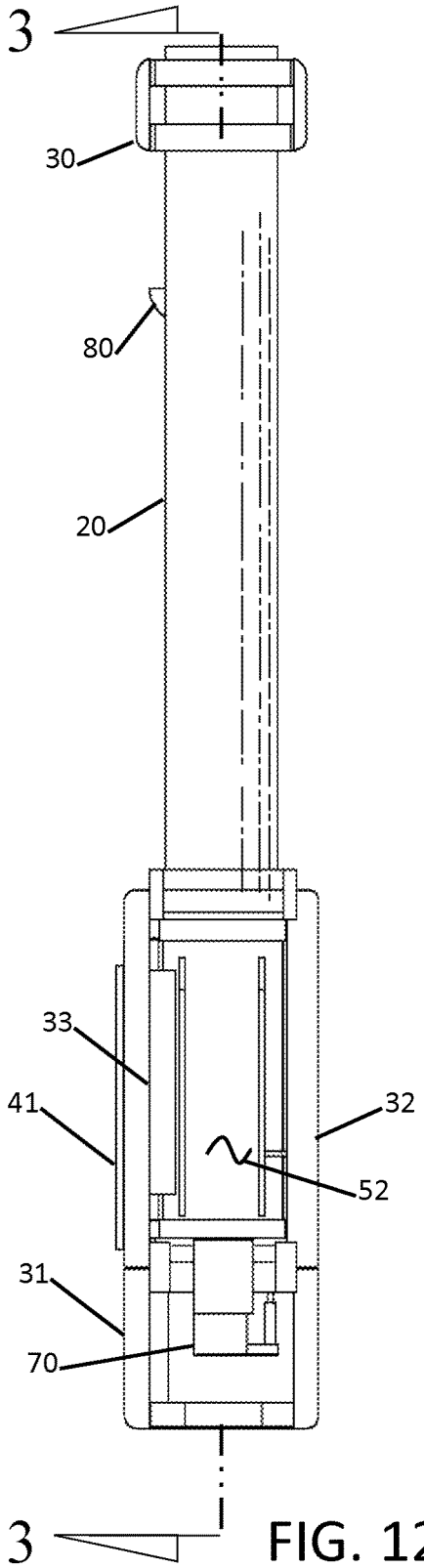
FIG. 12 shows a bottom view of the two-part chamber locking assembly with the exterior housings removed.
Figure 13:
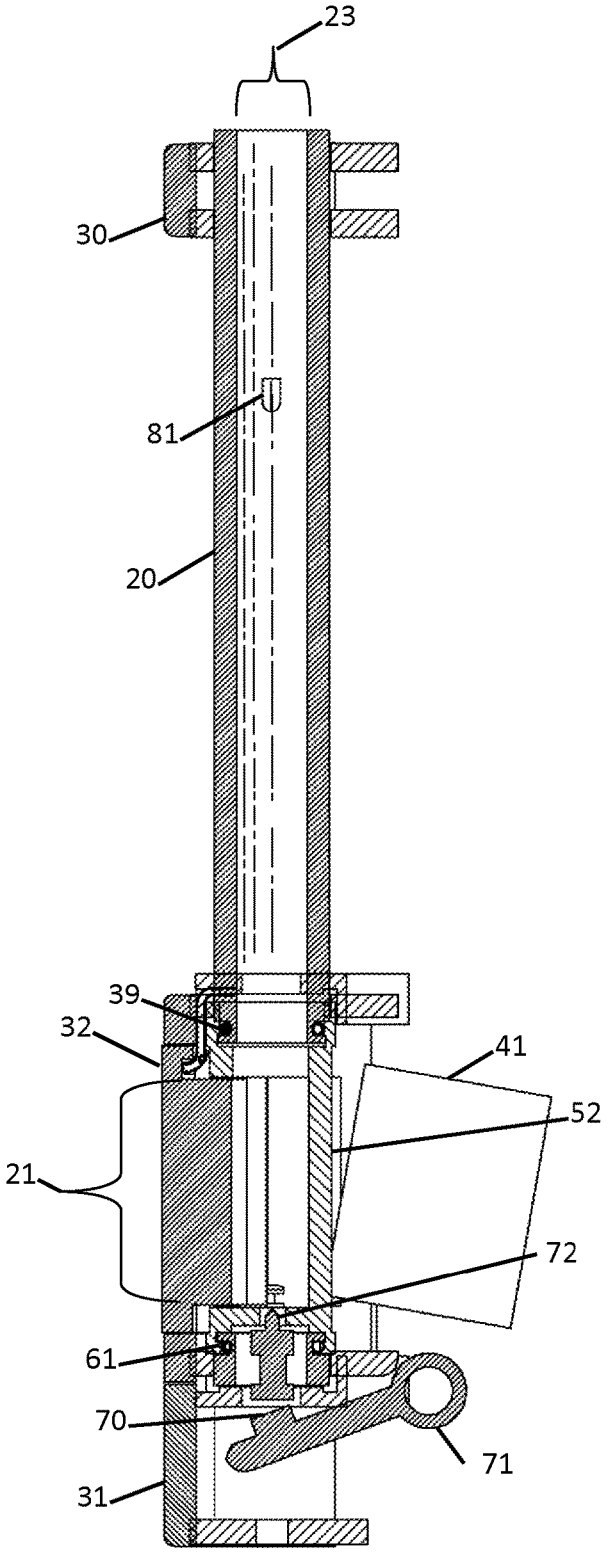
FIG. 13 is a side cross-sectional view taken through section line 13-13 from FIG. 12.

FIG. 12 shows a bottom view of the two-part chamber locking assembly with the exterior housings removed, and looking at the bottom of the breach 52, and FIG. 13 is a side cross-sectional view taken through section line 13-13 from FIG. 12. It should be noted that the location of the front gas tube 88, in some of the figures, has been moved closer to the front frame 34 to enlarge the size of the parts in the figure frame. The barrel 20 is shown extending vertically in these figures and terminating through the front site block 30. The front gas tube 88 is shown extending from inside barrel 20 at a front tube in the barrel 81. While FIG. 3 shows a portion of the tube within barrel 20, the front gas tube 88 essentially terminated at the inner diameter of bore 23 of barrel 20. At the other end of barrel 20, barrel 20 terminates in the rotary barrel assembly 32.

The rotary chamber assembly 32 chambers a cartridge with a projectile (not shown) in a chamber 21 of a breach. Chamber 21 is rotate in rotary barrel assembly 32 that is biased by a front spring 39 and a rear spring 61. The front spring 39 and the rear spring 61 hold the cartridge in a desired position for firing and also holds the ejection door closed. A trigger mechanism 70 is retained in the rear site block 31. The trigger mechanism is shown in FIG. 3 with a hammer pivot 71 where the hammer mechanism 70 rotates so the hammer pushes a firing pin 72 into the primer (not shown) of the cartridge (not shown) to ignite gunpowder within the cartridge to propel a projectile (not shown) down the barrel 20.

The hammer mechanism 70 or striker is shown in this embodiment with a direct impingement or piston actuated action on the primer of a cartridge, however it's anticipated that the mechanism can actuate mechanically off of the rotating chamber, electrically, hydraulically, though ferro fluid or chemically. The actuation can utilize aspects from a common revolver, which includes single and double actions that move the hammer/strike, primary cylinder, cylinder cap, and ejector systems.

FIG. 13 also shows the upper frame 41 that is retained in the grip of the firearm. When the cartridge is fired the expanding gunpowder propels the projectile out of the barrel 20 and the expanding gunpowder rotates the rotary barrel assembly 32 against the front spring 39 and the rear spring 61 where the spent shell is ejected out of the side of the rotary barrel assembly 32 out of an ejector port 33. For better clarity of the rotating barrel assembly 32 the site blocks 30 and 31 are removed in the next few figures.

Figure 14:
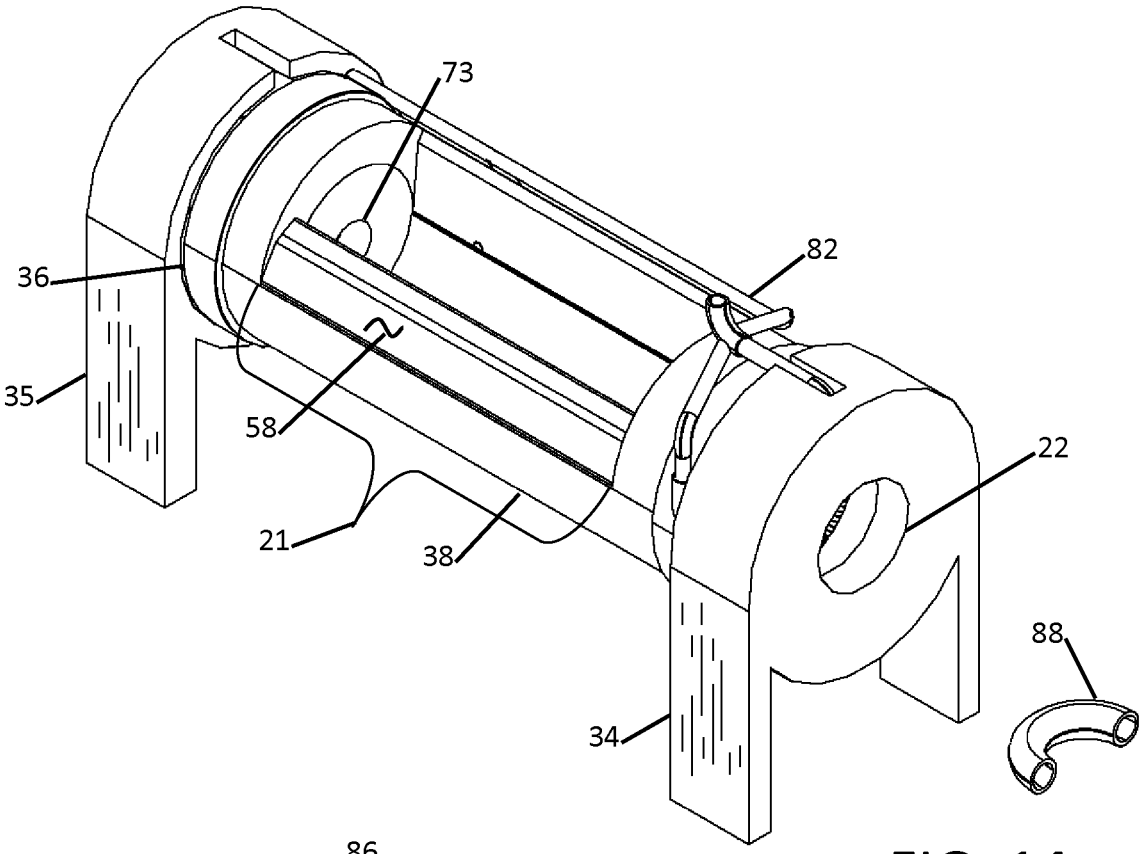
FIG. 14 shows a perspective view of the breach and frame with the barrel removed.
Figure 15:
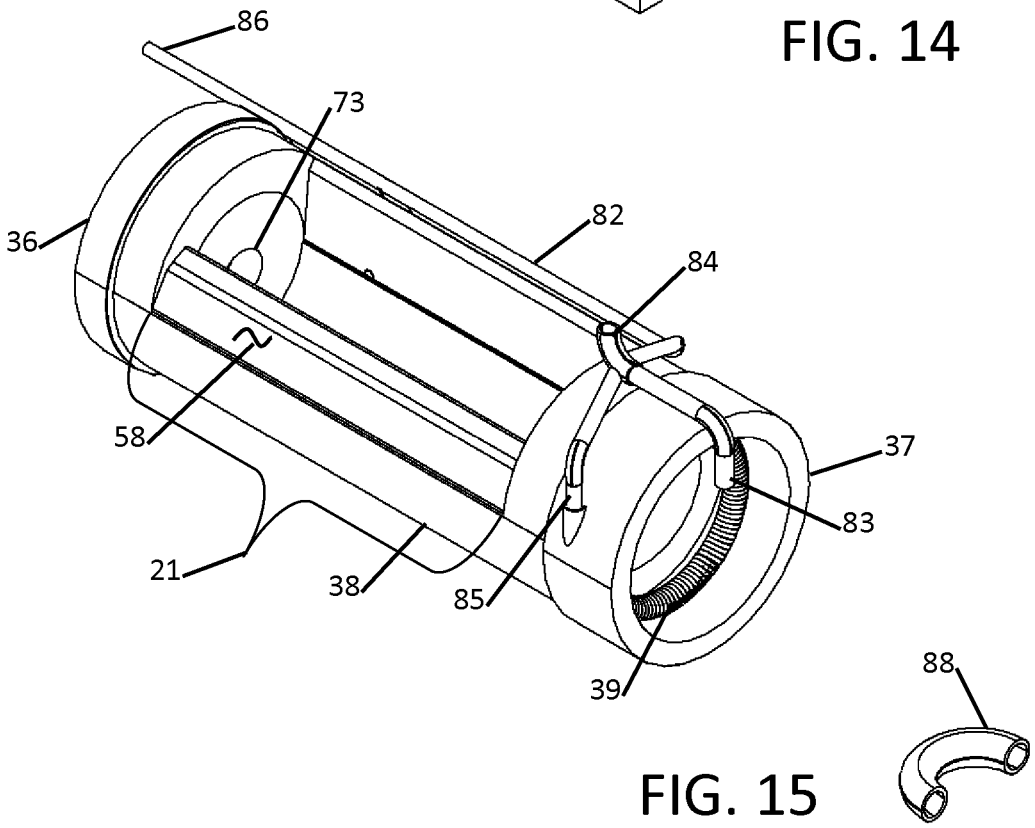
FIG. 15 shows a perspective view of the breach with the tubes.

FIG. 14 shows a perspective view of the breach and frame with the barrel removed and FIG. 15 shows a perspective view of the breach with the tubes. There is a front frame 34 and a rear frame 35 that supports the breach therein between. The front frame 34 and the rear frame 35 are supported within the rear site block 31 (previously shown and described). The breach or firing chamber 21 is configured to rotate within the front frame 34 and the rear frame 35 components and are biased in a rotational position with a front spring 39 in a front rotation frame 37. In this preferred embodiment a relatively fixed rotary barrel assembly 32 chamber is shown and described, but it is anticipated that the rotary barrel assembly 32 chamber can also cam or otherwise actuate both vertically and or horizontally.

A rear spring (not visible in this figure) is located in rear rotation frame 36. The front spring 39 (and a rear spring) in this embodiment is essentially a compression spring set in between the rotating breach and the rotation frames in an arc sector recess. While a compression spring is shown and described, other springs or biasing mechanisms are contemplated, including but not limited to, a torsion spring, extension spring and air-filled piston. Breach or firing chamber 21 has a circular breach frame 38 with an ejection door 58 where a spent cartridge is ejected. Although a typical circular breach frame 38 is indicated, it's anticipated that caseless ammo will be utilized, as well as two-part system Ammo wherein the propellent and round are contained separately.

When the cartridge is fired the projectile (not shown) will pass through an opening 22 in the front frame 34 and enter barrel 20 (previously shown and described). Although the current system indicates a typical ejector featured on the rotating barrel assembly 32 cylinder, other mechanical and non-mechanical based ejection systems are anticipated, including a gateway hole drilled in the rotating barrel assembly 32 cylinder system that is timed to directly impinge or mechanically actuate the removal of the contained round as needed.

Expanding gunpowder from the cartridge passes into ports 83, side port 85 (or more ports) into the manifold tube 82 and or front gas tube 88. The pressurized expanding gunpowder pushes against blade(s) connected to the circular breach frame 38 to overcome the spring force of the front spring 39 (and rear spring) to rotate the circular breach frame 38. The manifold 82 can also be connected to an upper port 84 and or rear port 86 for operation of ejecting the spent shell. The preferred embodiment discloses one primary rotating barrel assembly 32 and one primary cylinder cap, but it is contemplated that multiple components can be used.

Figure 16:
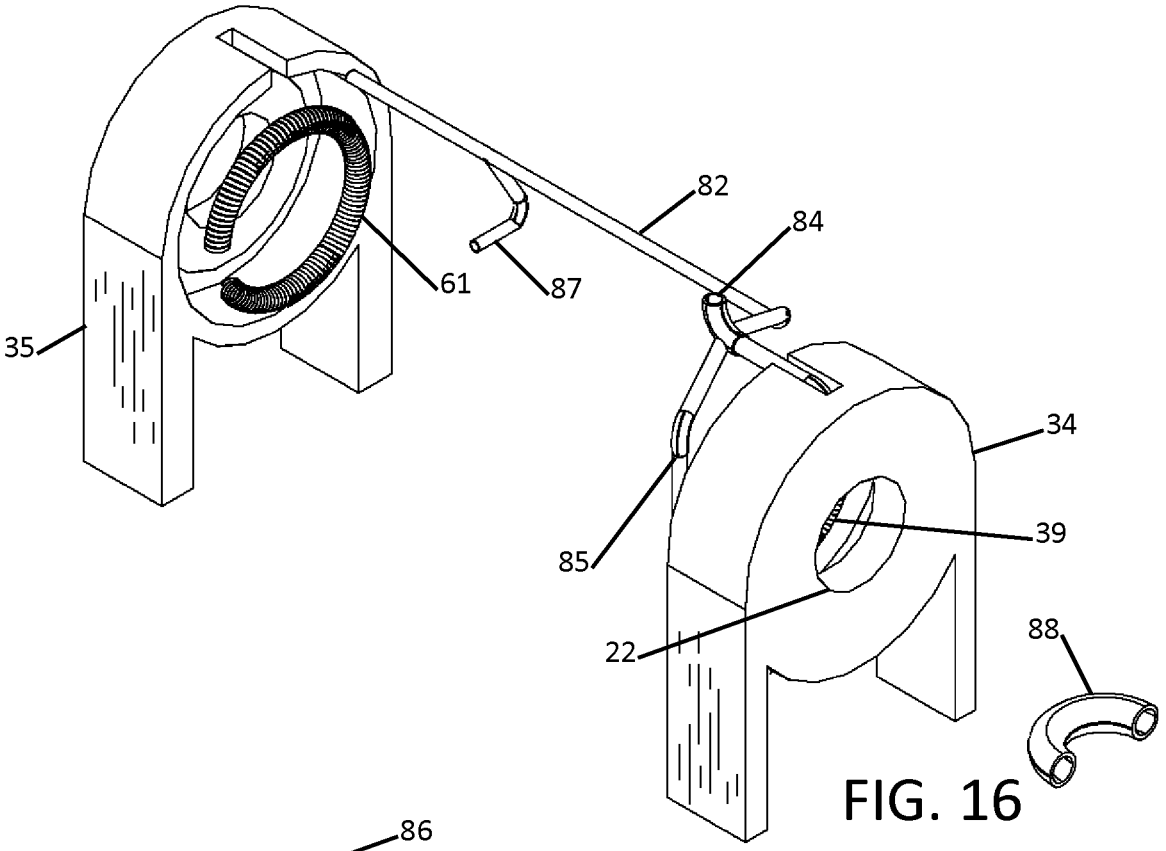
FIG. 16 shows a perspective view of the front and rear frames with the breach removed.
Figure 17:
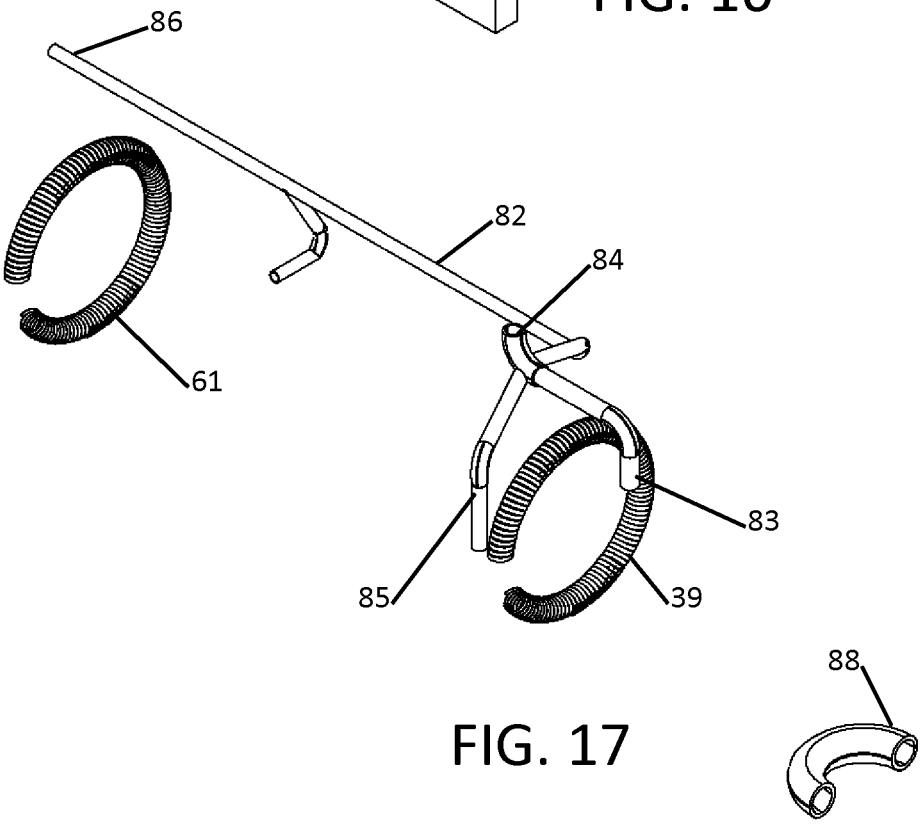
FIG. 17 shows a perspective view of the radial spring and the tubes.

FIG. 16 shows a perspective view of the front frame 34 and rear frame 35 with the breach removed and FIG. 17 shows a perspective view of the radial springs 39 and 61 and the tubes. The rotational position of the breach is maintained with the front spring 39 and the rear spring 61. The springs 39 and 61 are essentially compression springs set between the rotating breach and the rotation frames in arc sector recesses. While compression spring(s) are shown and described, other springs or biasing mechanism are contemplated, including but not limited to, a torsion spring, extension spring and air-filled piston to bias the position of the breach in the firearm. The rotary compression springs 39 and 61 are the preferred embodiments, but other means of compression and actuation are anticipated including, pneumatic, hydraulic, ferro fluid, electrical, magnetic, chemical actuation or using a pawl and ratchet are anticipated.

When the cartridge is fired the projectile (not shown) will pass through an opening 22 in the front frame 34. Expanding gunpowder from the cartridge passes into ports 83, side port 85 (or more ports) into the manifold tube 82 and or front gas tube 88. The pressurized expanding gunpowder pushes against blade(s) connected to the circular breach frame 38 to overcome the spring force of the front spring 39 and the rear spring 61 to rotate the circular breach frame. The manifold 82 can also be connected to an upper port 84 and or rear port 86 and or side port(s) 87 for operation of ejecting the spent shell.

Figure 18:
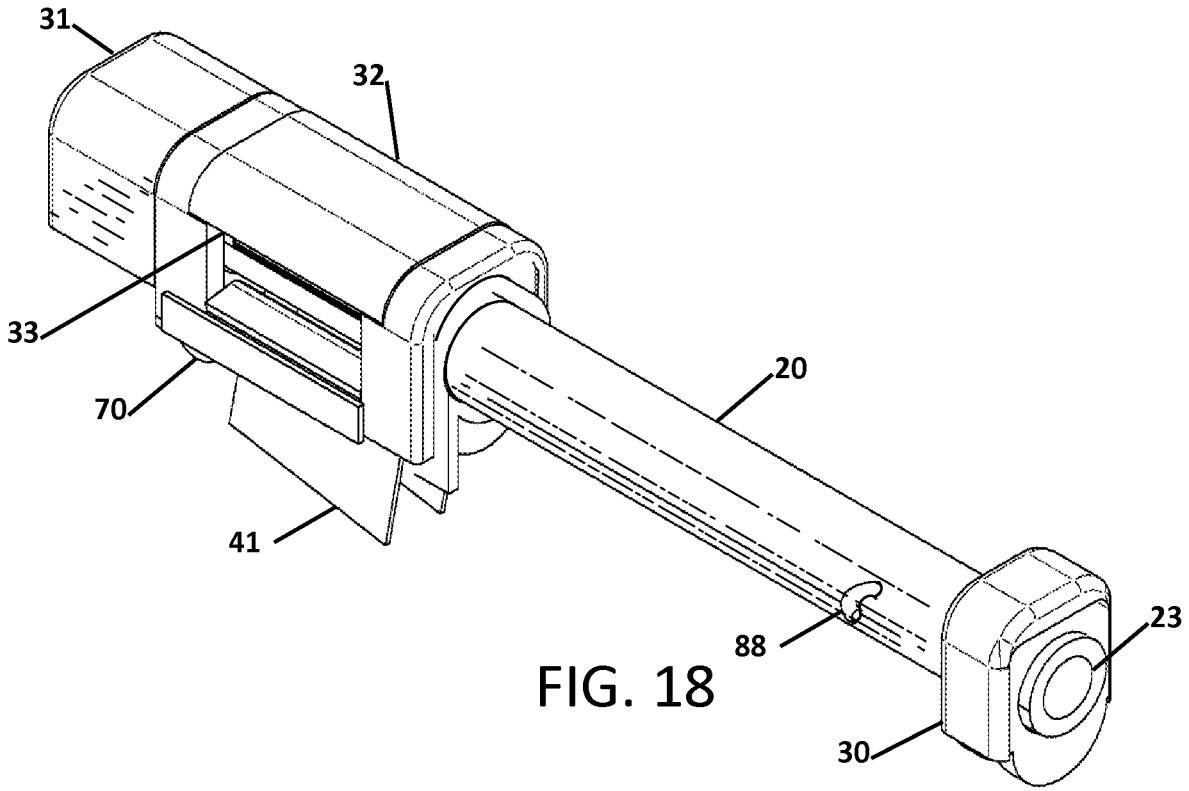
FIG. 18 shows a front perspective view of the two-part chamber locking assembly.

FIG. 18 shows a front perspective view of the two-part cylindrical locking assembly. The two-part cylindrical locking assembly has barrel 20 having a front site block 30 where a projectile exits the bore 23 at one end of the barrel 20 and a rear site block 31 at the opposing end. A portion of the front gas tube is shown extending from barrel 20. The two-part cylindrical locking assembly is shown within rotary barrel assembly 32 having a side ejector port 33. The internal features and function of the loading, firing of the hammer 70 and shell ejection through the ejector port 33. The two-part cylindrical locking assembly is shown with the upper frame 41 that would be integrated into the handgrip of the firearm.

Figure 19:
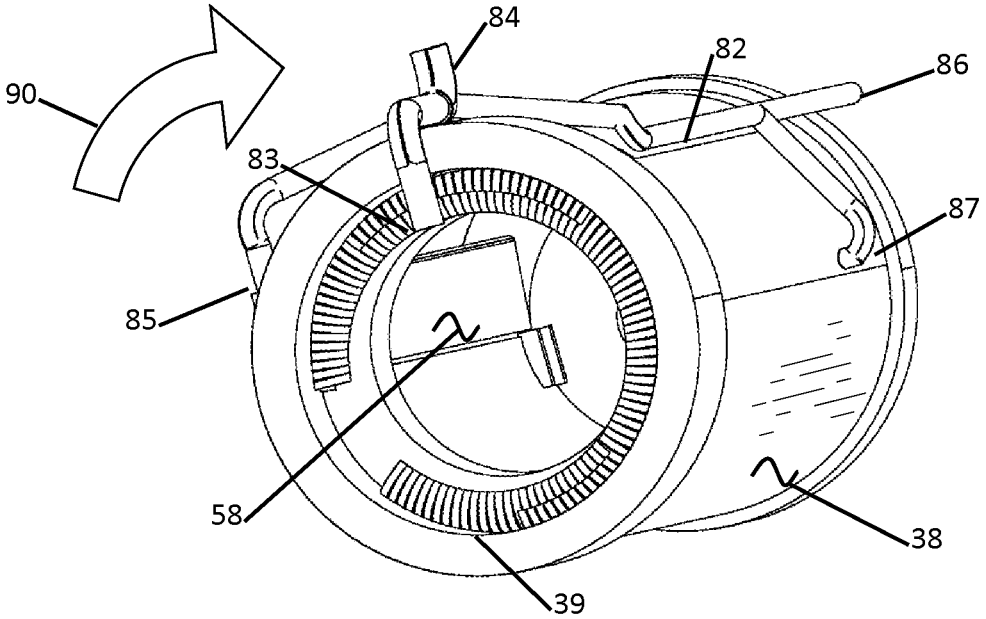
FIG. 19 shows a perspective view looking into the breach from the barrel end.

FIG. 19 shows a perspective view looking into the breach from the barrel end. When the cartridge is fired, expanding gunpowder from the cartridge passes into ports 83, side port 85 (or more ports) into the manifold tube 82 and or front gas tube 88. The pressurized expanding gunpowder pushes against blade(s) connected to the circular breach frame 38 to overcome the spring force of the front spring 39 and the rear spring 61 (not visible in this view) to rotate 90 the circular breach frame 38. In this preferred embodiment the spent shell ejection system is temporarily slowed down to capture the optimum amount of expanding gun powder prior to the projectile exiting barrel 20. The manifold 82 can also be connected to an upper port 84 and or rear port 86 and or side port(s) 87 for operation of ejecting the spent shell out of the ejection door 58. The preferred embodiment reduces the weight and materials needed to actuate all components, so more energy is available to transfer rotating energy.

The current embodiment represents a direct impingement based vertically lifting cylinder cap, while other forms of actuation are anticipated including mechanically, rotary, cam, rotating, pneumatic, hydraulically, chemical, pawl and ratchet and liquid metal based.

Thus, specific embodiments of a ballistic with a two-part cylindrical locking assembly have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A ballistic with multi-part chamber locking assembly comprising:

a first part having a fixed frame that supports at least a second part having a translating chamber;

said translating chamber is biased at a first position within said fixed frame;

said translating chamber being aligned with a hole in said fixed frame and a hole in a barrel when a projectile is chambered that is configured for said projectile to pass therethrough;

launching said projectile causes said translating chamber to translate out of said fixed frame and eject a temporarily retained shell out a side of said translating chamber;

wherein a bottom of said translating chamber includes a blade that passes between adjacent shells in a single removable magazine;

after said shell has been ejected a second projectile is loaded vertically into said translating chamber from a said single removable magazine that loads said second projectile into said fixed frame, and said translating chamber closes onto said second projectile when said second projectile is in said fixed frame.

2. The ballistic with multi-part chamber locking assembly according to claim 1, wherein said biasing mechanism is at least one compression spring.

3. The ballistic with multi-part chamber locking assembly according to claim 1, further includes at least one vent pipe that is connect to fixed frame to direct expanding gun powder from launching said projectile to expand a translating barrel outward from said fixed frame and eject said shell.

4. The ballistic with multi-part chamber locking assembly according to claim 1, wherein said firearm is a handgun, a rifle, or an artillery system.

5. The ballistic with a multi-part chamber locking assembly according to claim 1, further includes at least one vent pipe that is connect to fixed frame to direct expanding gun powder from launching said projectile to push said translating barrel.

6. The ballistic with a multi-part chamber locking assembly according to claim 1, wherein said projectile is retained in a shell having a rectangular or circular cross-section.

7. The ballistic with a multi-part chamber locking assembly according to claim 6, wherein said shell is retained in said translating chamber with a breach shell retainer.

8. The ballistic with a multi-part chamber locking assembly according to claim 7, wherein said breach shell retainer rotates said shell within said breach after said projectile is fired.

9. The ballistic with a multi-part chamber locking assembly according to claim 7, wherein said shell has at least one recessed casing tab whereby said breach shell retainer engages in said at least one recessed casing tab on said shell.

10. The ballistic with a multi-part chamber locking assembly according to claim 7, wherein said beach shell retainer engages onto a second shell when said translating chamber closes into said fixed frame.

11. The ballistic with a multi-part chamber locking assembly according to claim 1, wherein said ejection is out a top of said translating chamber.

12. The ballistic with a multi-part chamber locking assembly according to claim 1, wherein said shell is ejected out of an opening above said fixed frame.

13. The ballistic with a multi-part chamber locking assembly according to claim 1, wherein said translating chamber translates from said fixed frame on at least one linear slide.

14. The ballistic with a multi-part chamber locking assembly according to claim 13, wherein there are four linear slides.

15. The ballistic with a multi-part chamber locking assembly according to claim 1, wherein said fixed frame includes a slide door lock.

16. The ballistic with a multi-part chamber locking assembly according to claim 15, wherein said slide door lock is disengaged when expanding gunpowder passes through at least one vent pipe.

* * * * *